US011800944B2

(12) United States Patent
Markelz et al.

(10) Patent No.: US 11,800,944 B2
(45) Date of Patent: Oct. 31, 2023

(54) CLOTHES HANGERS AND CLIPS USED THEREWITH

(71) Applicants: Andrew Michael Markelz, Muncie, IN (US); Lindsey Lee Markelz, Muncie, IN (US)

(72) Inventors: Andrew Michael Markelz, Muncie, IN (US); Lindsey Lee Markelz, Muncie, IN (US)

( * ) Notice: Subject to any disclaimer, the term of this patent is extended or adjusted under 35 U.S.C. 154(b) by 638 days.

(21) Appl. No.: 16/674,930

(22) Filed: Nov. 5, 2019

(65) Prior Publication Data

US 2020/0138219 A1 May 7, 2020

Related U.S. Application Data

(60) Provisional application No. 62/755,797, filed on Nov. 5, 2018.

(51) Int. Cl.
*A47G 25/48* (2006.01)
*A47G 25/20* (2006.01)

(52) U.S. Cl.
CPC ..... *A47G 25/482* (2013.01); *A47G 25/20* (2013.01)

(58) Field of Classification Search
CPC ..... A47G 25/20; A47G 25/486; A47G 25/16; A41B 3/06; A41B 3/08
USPC ..... 223/90, 91, 93, 88, 96
See application file for complete search history.

(56) References Cited

U.S. PATENT DOCUMENTS 1,014,976 A * 1/1912 Rein ..... A47G 25/486 223/93
1,237,347 A * 8/1917 Lipoti ..... A47G 25/486 223/93
1,458,066 A * 6/1923 Edward ..... A47G 25/485 223/111
1,716,985 A * 6/1929 Spear ..... A47G 25/486 D6/318
1,768,005 A * 6/1930 Schwartzman ..... A47G 25/486 D6/318
1,999,310 A 4/1935 Tompson
2,170,479 A * 8/1939 Lyman ..... A47G 25/486 223/94
2,270,828 A * 1/1942 Von Palmenberg ..... A47G 25/485 223/91
2,503,844 A * 4/1950 Rotheraine ..... A47G 25/52 223/91
2,849,168 A * 8/1958 Boyer ..... A47G 25/485 223/91
2,891,707 A * 6/1959 Shrom ..... A47G 25/48 D6/319
3,165,245 A * 1/1965 Levine ..... A47G 25/16 223/91
3,651,999 A * 3/1972 Fiocca ..... A47G 25/16 223/88

(Continued)

FOREIGN PATENT DOCUMENTS

CN 203709762 U 7/2014
JP H11192148 A 7/1999

(Continued)

*Primary Examiner* — Nathan E Durham
(74) *Attorney, Agent, or Firm* — Indiana University Maurer School of Law Intellectual Property Legal Clinic

(57) ABSTRACT

A clothes hanger is provided that has a fixed or attached support with clips attached which allow a user to slip the collar leaves of a button-down or other shirt into the clips.

4 Claims, 11 Drawing Sheets

(56) References Cited

U.S. PATENT DOCUMENTS

| | | | | | |
|---|---|---|---|---|---|
| 3,710,993 | A | | 1/1973 | Collin | |
| 4,877,163 | A | * | 10/1989 | Zimmerman | A47G 25/48 24/301 |
| 5,113,554 | A | | 5/1992 | Gallo | |
| 5,400,932 | A | | 3/1995 | Hollis | |
| 5,613,628 | A | | 3/1997 | Burkhalter | |
| 5,975,384 | A | | 11/1999 | Manabat | |
| 6,050,462 | A | | 4/2000 | Petrou | |
| 6,296,160 | B1 | | 10/2001 | Murray | |
| D546,078 | S | * | 7/2007 | Foreman | D6/319 |
| 8,925,770 | B1 | * | 1/2015 | Garcia | A47G 25/20 223/91 |
| 10,426,283 | B2 | * | 10/2019 | Karelis | A47G 25/28 |
| 2006/0037981 | A1 | | 2/2006 | Dedo | |

FOREIGN PATENT DOCUMENTS

| | | | |
|---|---|---|---|
| JP | 2006087787 | A | 4/2006 |
| JP | 2007125088 | A | 5/2007 |
| JP | 3147711 | U | 12/2008 |
| JP | 5647323 | B1 | 12/2014 |

* cited by examiner

CLOTHES HANGERS AND CLIPS USED THEREWITH

RELATED APPLICATION

The present application claims priority to U.S. Provisional Application No. 62/755,797, filed Nov. 5, 2018, titled "CLIPS ON CLOTHES HANGER TO HOLD BUTTON-DOWN SHIRT." The entire disclosure of which is hereby incorporated by reference

TECHNICAL FIELD

This disclosure relates to clothes hangers.

BACKGROUND AND SUMMARY

One manner for hanging a collared, button-down, shirt is to button the top button of the shirt when hung on a hanger. By buttoning the top button when hung, the shirt will be less likely to fall off the hanger, in addition, the integrity of the collar is maintained. However, it may be difficult to button collared shirts when hanging after wash or use.

The present disclosure relates to a hanger or hanger attachment that reduces the need for the top button on collared shirts to be buttoned when hanging a shirt and unbuttoned when taking a collared shirt off of the hanger. The device preferably includes two clips which allow a user to slip and clip each end of a collar of the shirt into the clips where they are held in position as if the collar buttons were buttoned.

According to the present disclosure, a hanger for a shirt is provided. The hanger comprises a hanger body including at least to two rods positioned to support shoulders of a shirt; a hook coupled to the hanger body and configured to support the hanger body; a support extending down from at least one of the hanger body and hook, and a pair of clips coupled to the support.

According to another aspect of the present disclosure, a hanger for a shirt is provided. The hanger comprises a hanger body including at least to two rods positioned to support shoulders of a shirt; a hook coupled to the hanger body and configured to support the hanger body; a pair of clips configured to clip collar leaves of a shirt; and at least one rigid support positioned to support the clips on at least one of the hanger body and the hook.

According to another aspect of the present disclosure, a method of supporting collar leaves of a shirt is provided. The method includes the steps of providing a hanger configured to support a shirt, the hanger including a hanger body, at least two clips, and a support positioned to support the at least two clips relative to the hanger body; attaching the clips to collar leaves of a shirt; and maintaining the relative position of the clips to the hanger body during the attaching step.

DESCRIPTION OF DRAWINGS

Some embodiments of the disclosure are provided as an example and are not limited by the figures of the accompanying drawings. Unless otherwise indicated, the components shown in the figures are proportional to one another.

DETAILED DESCRIPTION OF THE DISCLOSURE

The present disclosure is to be considered an exemplification of the invention and is not intended to limit the invention to the specific embodiments illustrated by the figures or description below.

Figure 1:
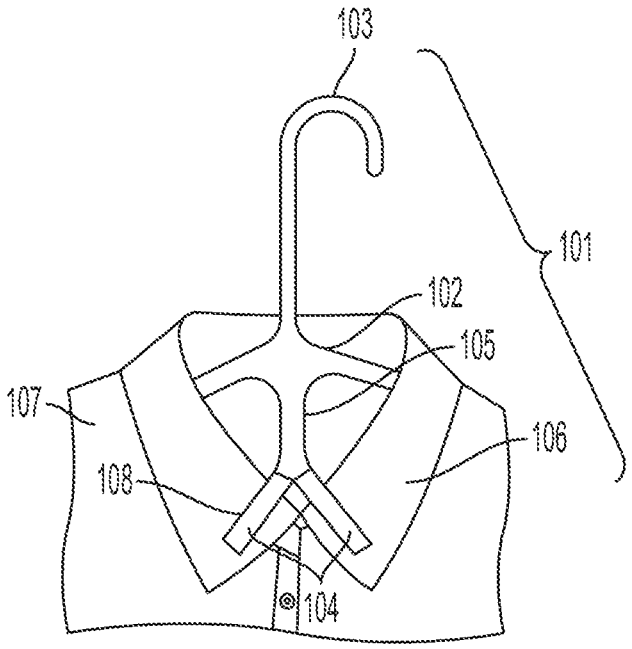
FIG. 1 is a front view of a hanger according to the present disclosure having a pair of clips positioned over collars of a shirt.
Figure 2:
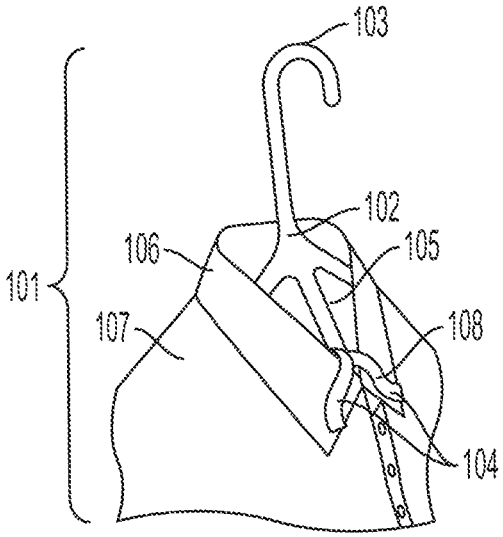
FIG. 2 is a left perspective view of the hanger of FIG. 1.
Figure 3:
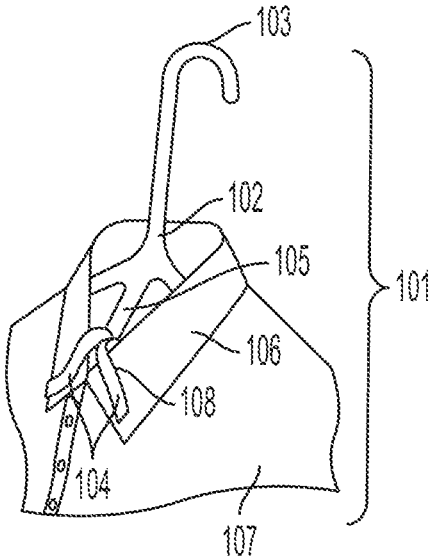
FIG. 3 is a right perspective view of the hanger of FIG. 1.

As shown in FIGS. 1-3, a hanger 101 includes a triangle-shaped hanger body 102 (only a portion shown), a hook 103, and a pair of clips 104. Clips 104 are suspended from hanger body 102 by a support 105 and hold down collar leaves 106 of shirt 107. Hanger body 102 may be made of plastic, metal (such as wire or other forms), wood, or other materials.

Figure 4A:
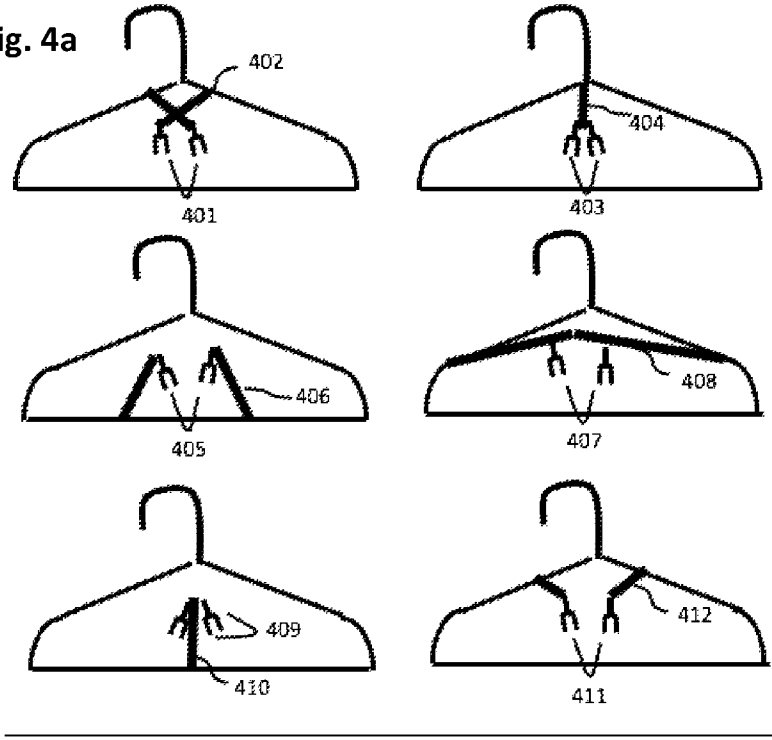
FIGS. 4*a*-4*c* show alternative embodiments hangers with different manners of supporting the pair of clips with FIG. 4*a* showing various clip positions on a hanger with a triangular shape, FIG. 4*b* showing various collar clip positions on a hanger without the bottom triangular bar, and FIG. 4*c* showing side views of various positions of clips.

As shown in FIG. 4*a*, clips can be supported by various means. For example, clips 401 are supported by X-shaped supports 402. Clips 403 are supported by a vertical support 404. Clips 405 are supported by supports 406 attached to the bottom portion of the hanger triangular bar. Clips 407 are supported by supports 408 attached at an extended distance from hook 103. Clips 409 are supported by one vertical support 410 attached to the bottom hanger triangular bar. Clips 411 are supported by two supports 412 attached in the middle of the top triangular shaped bars.

Figure 4B:
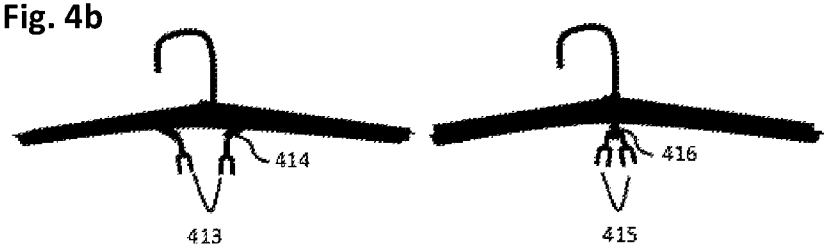

As Shown in FIG. 4*b*, clips can be supported by various means on non-triangular hangers as well. Clips 413 are supported by two support bars 414. Clips 415 are supported by one support bar 416.

Figure 4C:
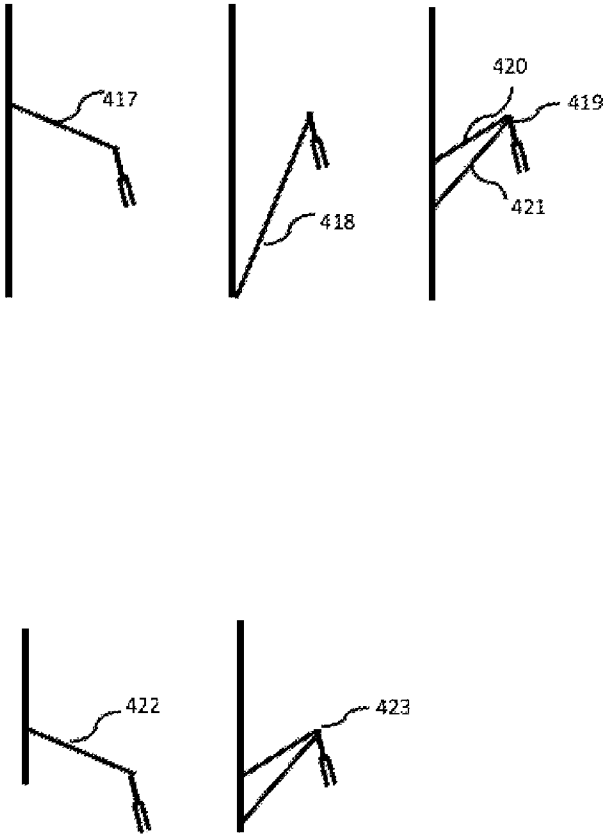

As shown in FIG. 4*c* (side view of hanger, clips, and support bar), the angle of attachment of support bars and clips to the hanger can vary. For example, support 417 extends down and out from the hanger body. Support 418 extends up and out from the hanger body. Support 419 includes an upper support member 420 and a lower support member 421 that extend up and out from the hanger body. Support 422 is similar to support 417, but it is provided on a hanger body without a lower bar, similar to the hanger bodies shown in FIG. 4*b*. Support 423 is similar to support 419, but it is provided on a hanger body without a lower bar, similar to the hanger bodies shown in FIG. 4*b*.

Figure 7:
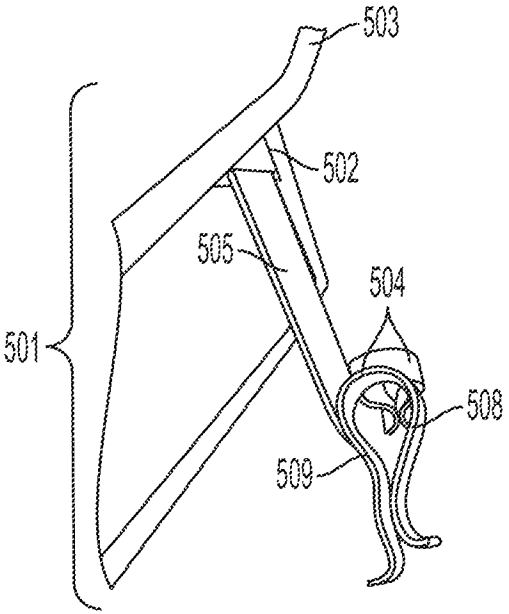
FIG. 7 is an enlarged perspective view of the hanger of FIG. 5.
Figure 6:
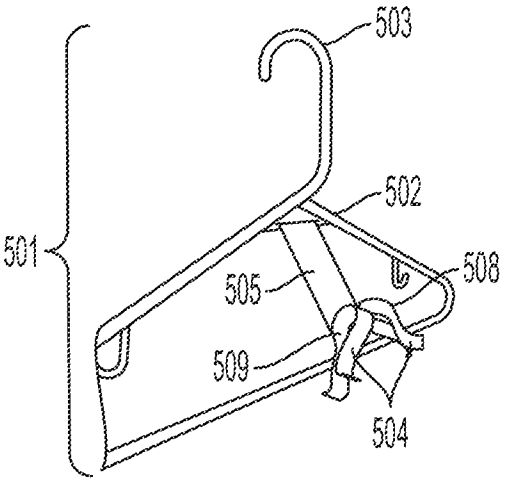
FIG. 6 is a perspective view of the hanger of FIG. 5.
Figure 5:
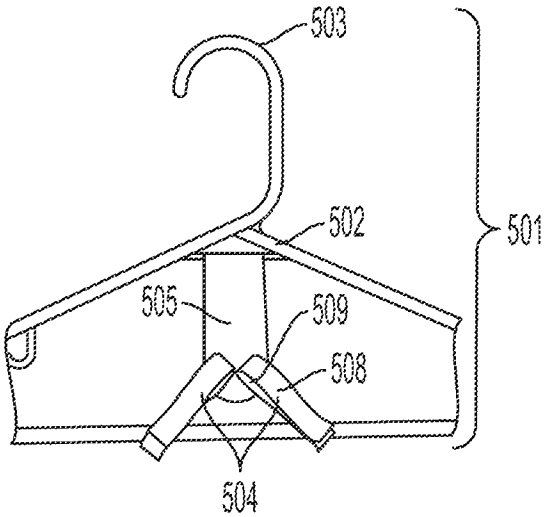
FIG. 5 is a front view of a portion of a plastic hanger with plastic clips supported from the plastic hanger with the clips configured to hold down each collar leaf of a shirt.
Figure 9:
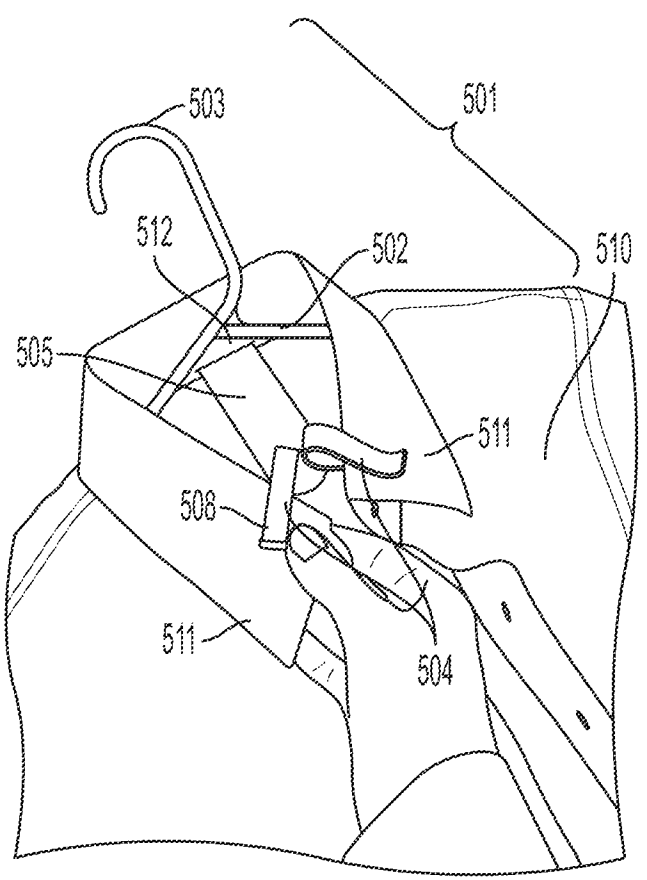
FIG. 9 is a view similar to FIG. 8 showing a user sliding the other collar leaf into a clip to be held down.
Figure 8:
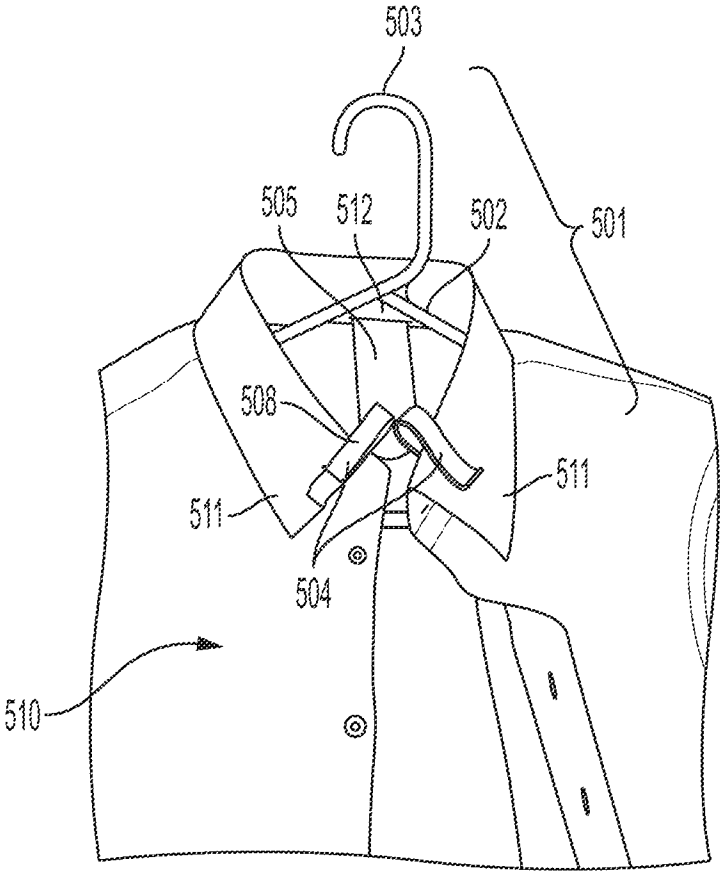
FIG. 8 is a view similar to FIG. 5 with a shirt on the hanger, showing one collar leaf held down by a clip and another collar leaf prior to being held down by a clip.

As shown in FIGS. 5-7, a hanger 501 includes a triangle-shaped hanger body 502 (only a portion shown), a hook 503, and a pair of clips 504. Clips 504 are suspended from hanger body 502 by a support 505. Clips 504 include front clip arm 508 and back clip arm 509.

In use, a user positions shirt 510 on hanger body 502 and then slides each collar leaf 511 into clips 504 supported by support 505. Support 505 attaches to hanger body 502 at hanger location 512, underneath hanger hook 503. Front clip arm 508 and back clip arm 509 clip collar leaves 511 therebetween.

Figure 10A:
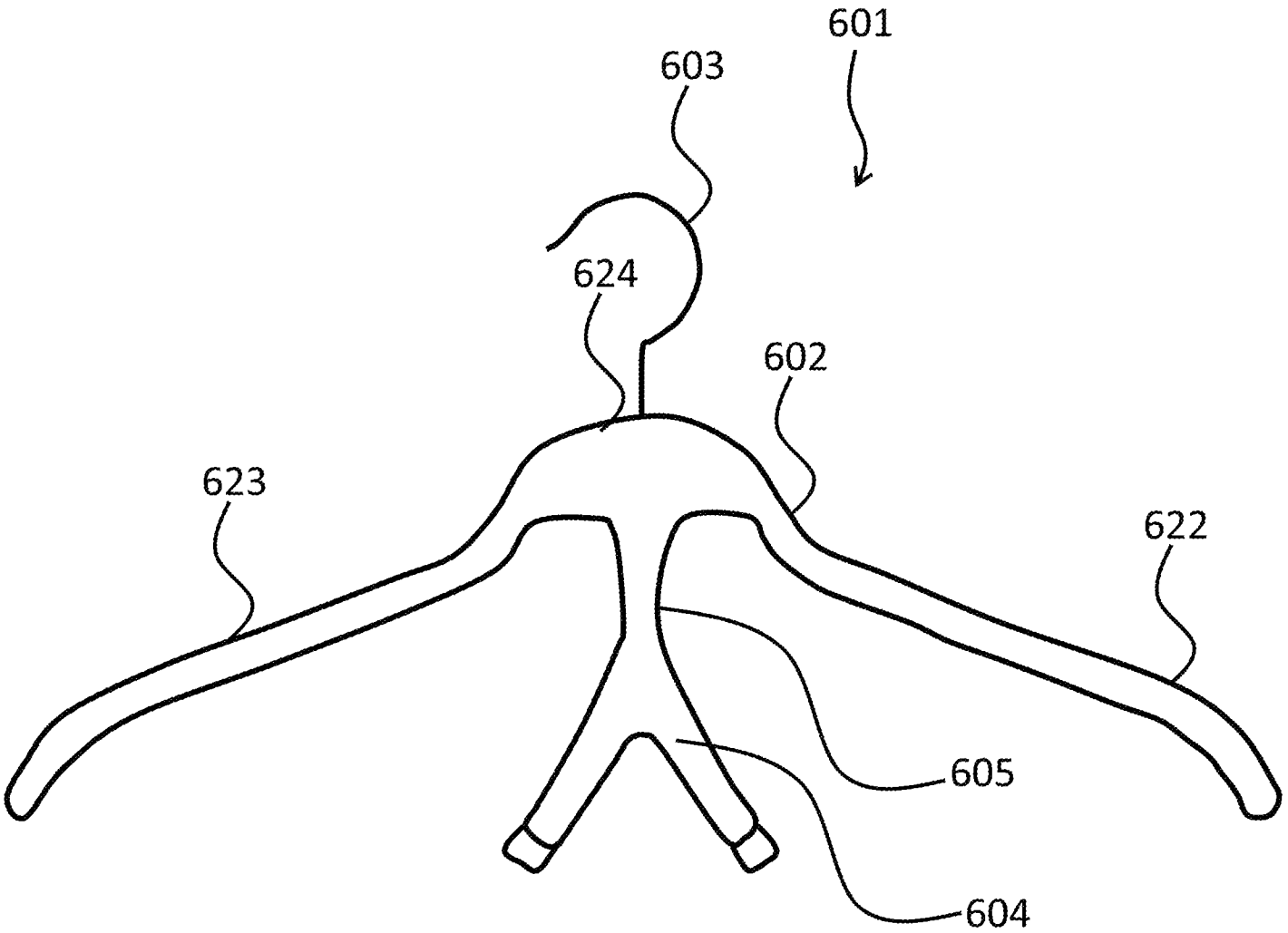
FIG. 10*a* is a front view of another hanger with an upside-down Y-shaped member with two clips.
Figure 10B:
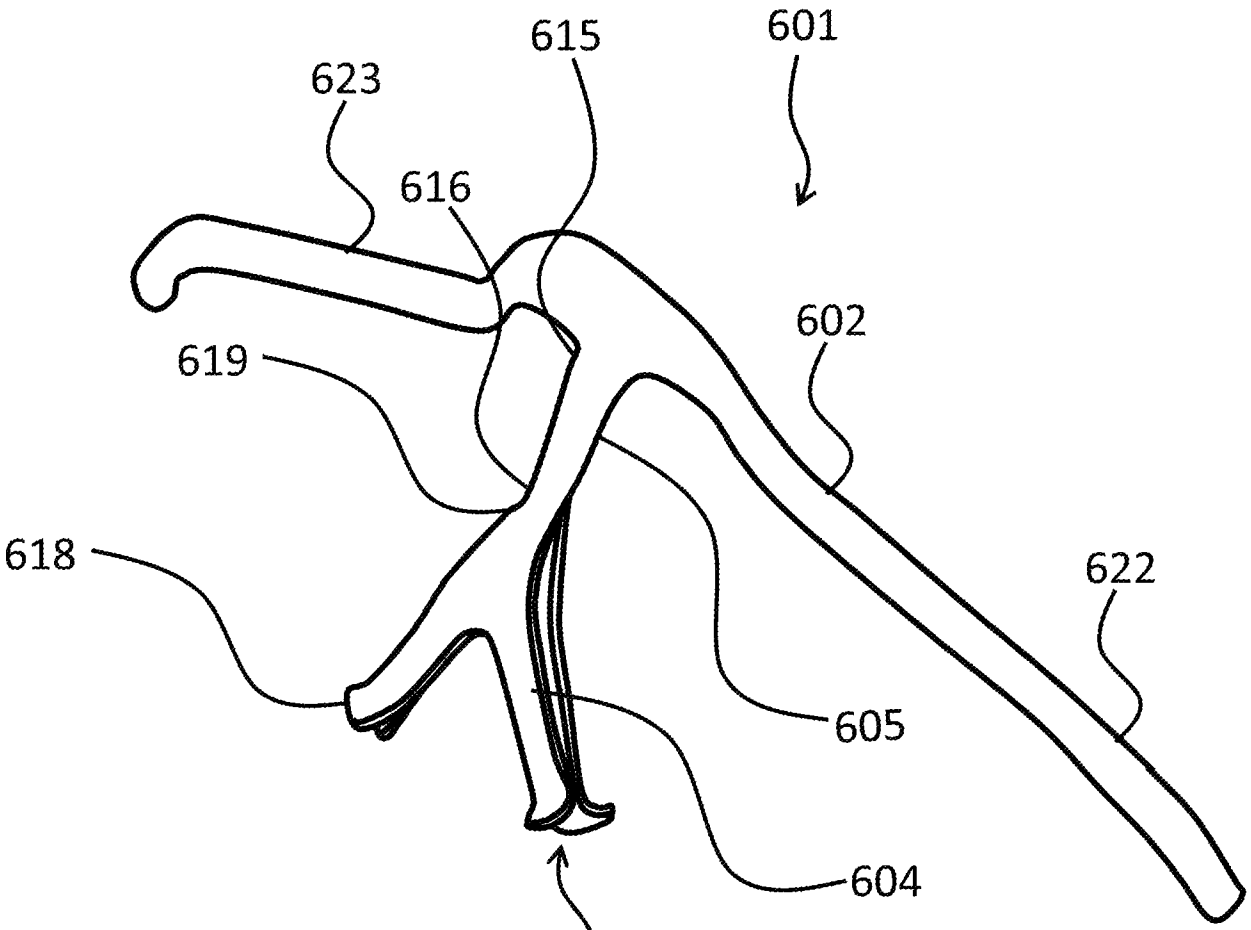
FIG. 10*b* is a perspective view of the hanger of FIG. 10*a* without a hanger hook.
Figure 10C:
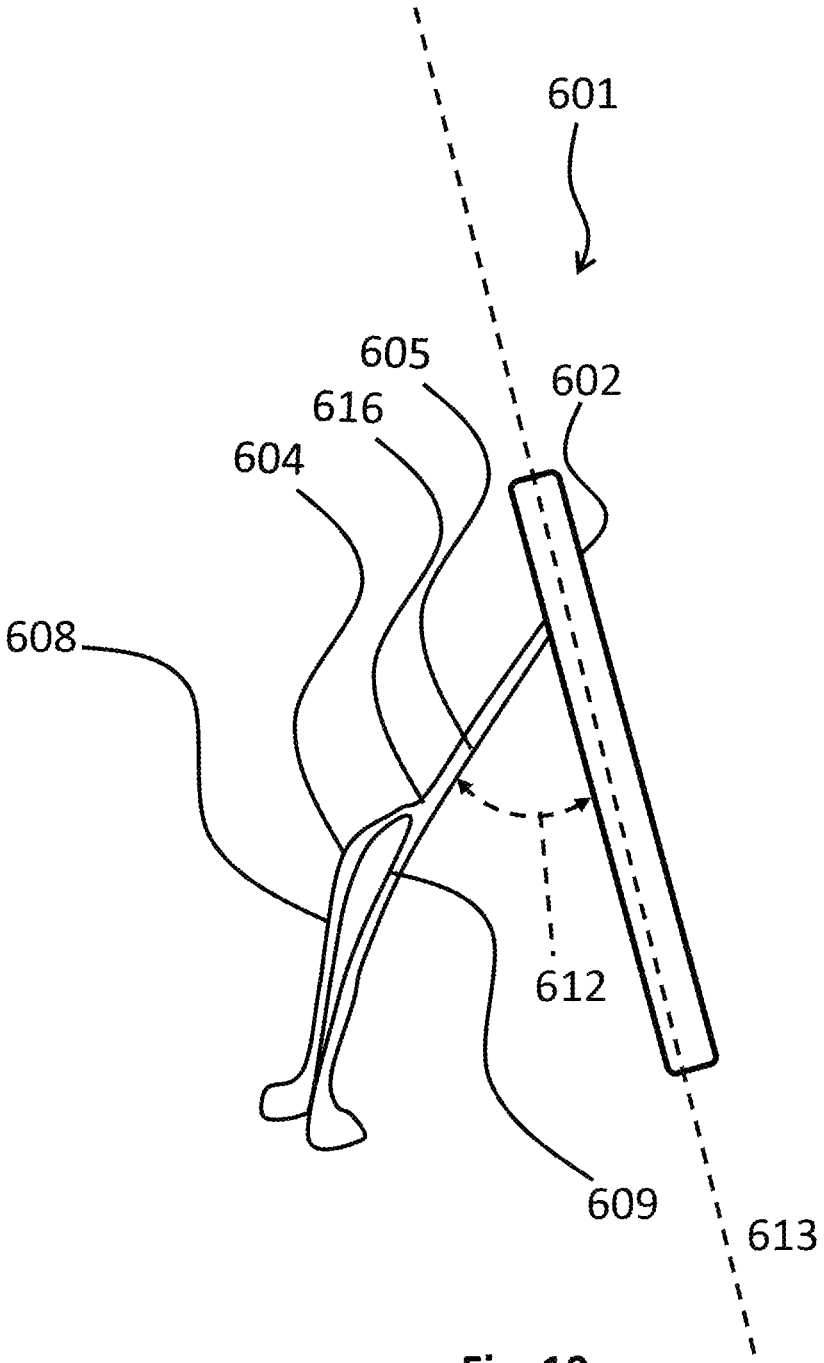
FIG. 10*c* is a side view of the hander of FIG. 10*a;*
Figure 10D:
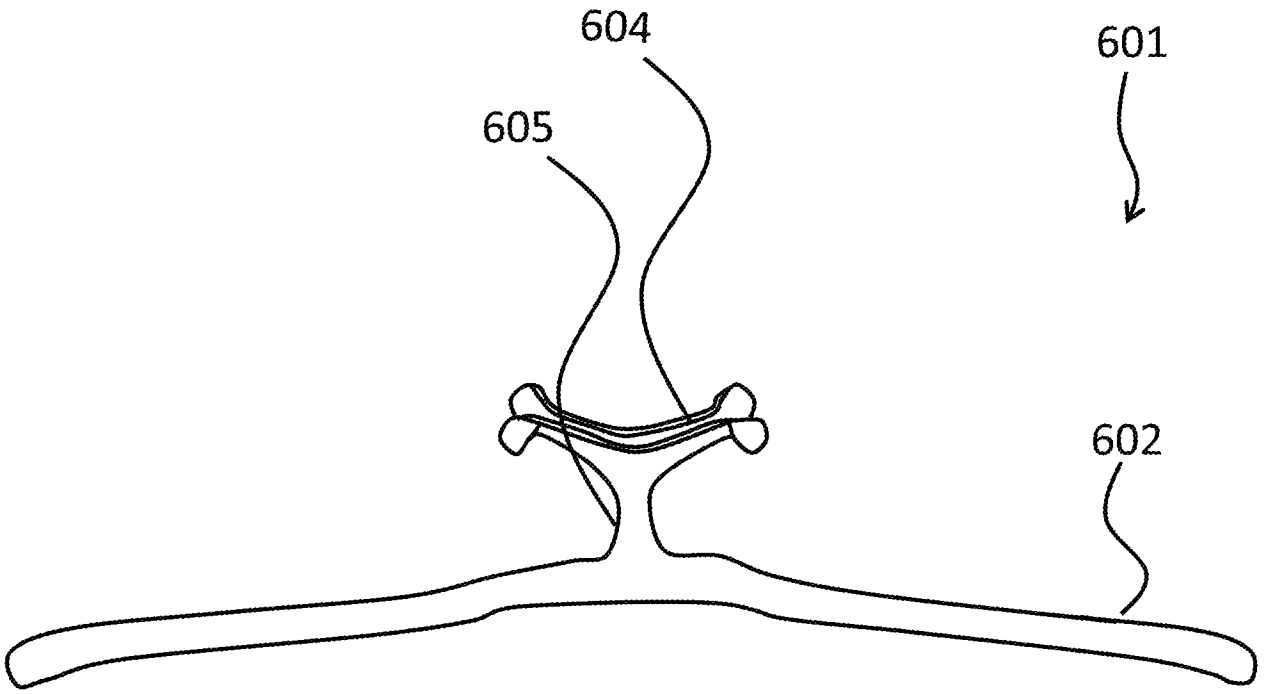
FIG. 10*d* is a bottom view of the hanger of FIG. 10*a;*
Figure 10E:
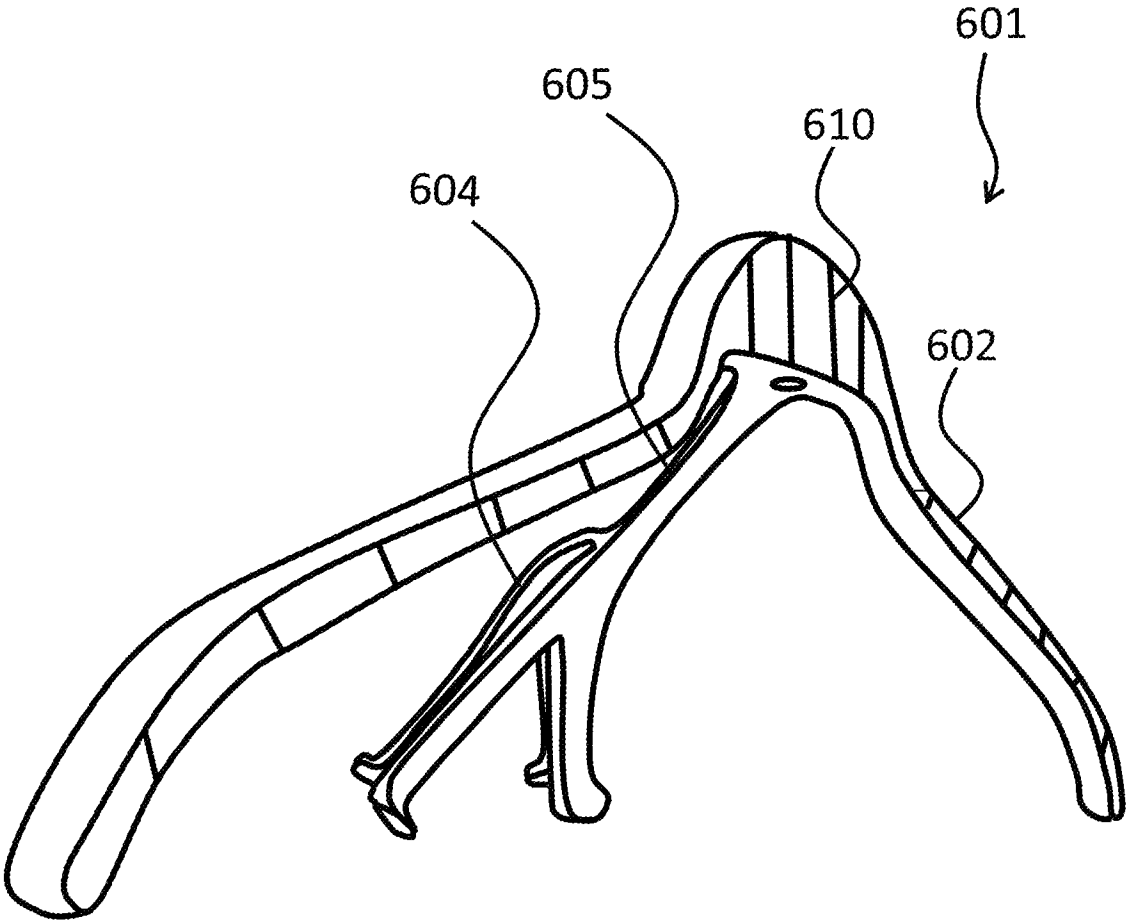
FIG. 10*e* is a back perspective view of the hanger of FIG. 10*a;*

According to another alternative embodiment, a hanger 601 includes a plastic triangle-shaped hanger body 602, a hook 603, and a pair of clips 604. As shown in FIG. 10*c*, an angle 612 larger than zero degrees exists between a plane 613 defined by hanger body 602 and support 605. Hanger body 602 further includes a base 624 of hook 603 as shown in FIG. 10*a*. As shown in FIG. 10*e*, hanger body 602 may be hollow and optionally have ribs 610 therein.

Hook 603 is a separate component from hanger body 602 and may be made of metal or another material. Hook 603 can be screwed into or otherwise fastened to hanger body 602. As shown in FIG. 10*c*, clip 604 includes a front clip arm 608 and a back clip arm 609. Back clip arm 609 is configured to press against front clip arm 608 to clip collar leaves of shirts therebetween. Front clip arm 608 and back clip arm 609 each has a lower end 618 and an upper end 619 (as shown in FIG. 10*b*). Upper ends 619 of the front and back clip arms 608, 609 are connected to a distal end 616 of support 605 opposite to a proximal end 615 of support 605 connected to hanger body 602. The distance between two lower end 618 of front and back clip arms 608, 609 enlarges gradually from an intermediate section of clips 604 toward an opening 614 of clips 604. Opening 614 is configured to receive the collar leaves. Further as shown in FIG. 10*c*, a distance between front clip arm 608 and back clip arm 609 first increases and then decreases toward distal end 616 of support 605 connected to hanger body 602.

Figure 11:
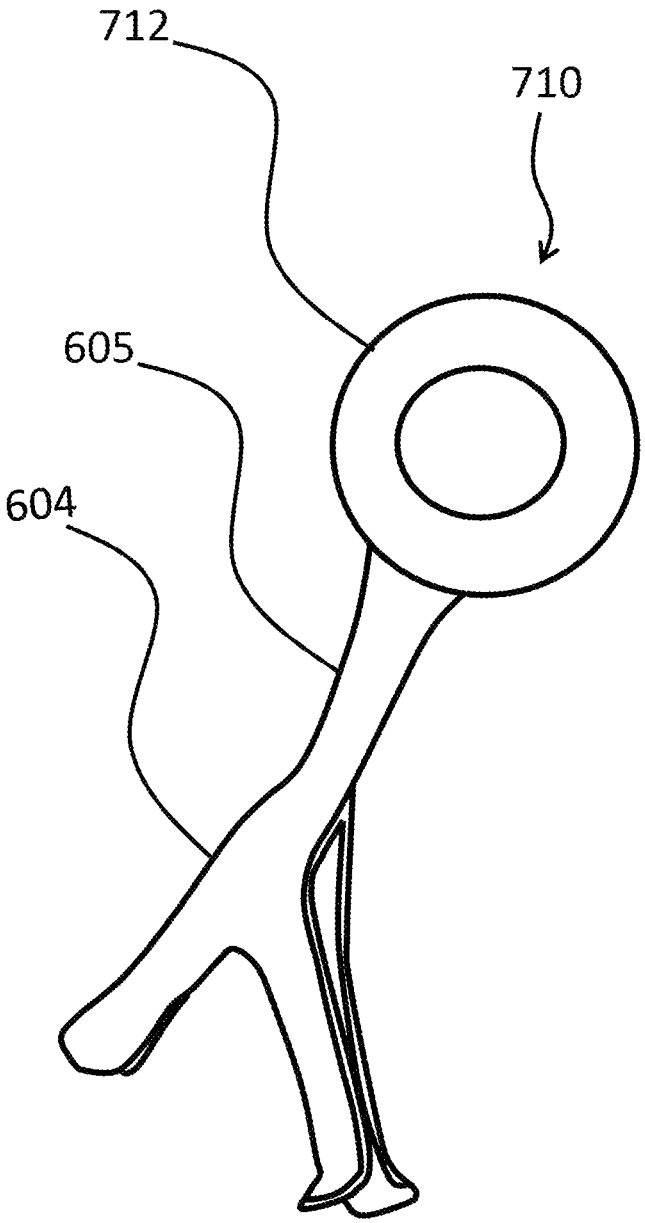
FIG. 11 shows a collar management device configured to be placed over a hanger.
Figure 12:
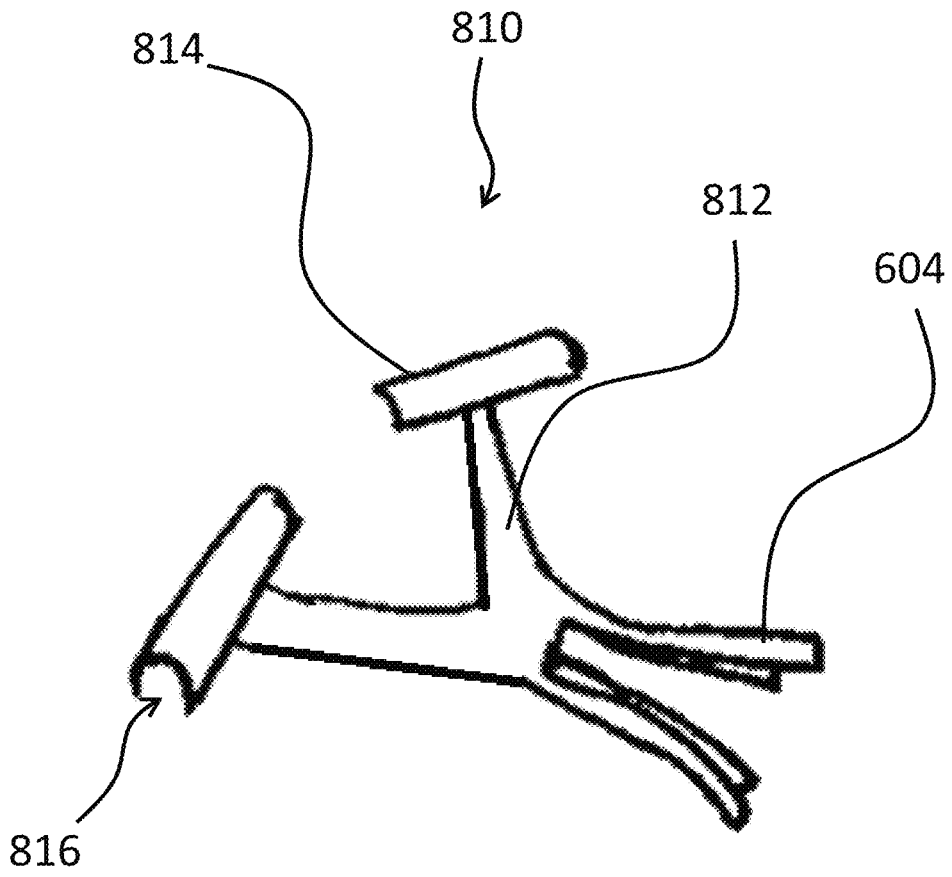
FIG. 12 show a collar management device configured to be clipped onto a hanger.

As discussed above, clips and supports may be fixed or integral with the hanger bodies. According to alternative embodiments, the clips and supports may be separate components from the hanger bodies and attached thereto. For example as shown in FIGS. 11 and 12, collar management devices 710, 810 are detachable from hanger bodies, such as those described herein and other hanger bodies. Collar management devices 710, 810 have clips 604 similar to other clips described herein.

Collar management devices 710, 810 each has supports 605, 812 configured to attach collar management devices 710, 810 to a hanger body. Collar management devices 710, 810 may be made of plastic.

As shown in FIG. 11, collar management device 710 includes a ring 712 positionable over a hook (for example hook 603) of a hanger body to attach collar management device 710 to hanger body. As shown in FIG. 12, collar management device 810 includes clasps 814 positionable to clasp to two top rods (similar to top rods 622, 623 as shown in FIG. 10*b*) of a hanger body to attach collar management device 810 to the hanger body. Ring 712 and clasps 814 are supports that allow collar management devices 710, 810 to be added or removed from hanger bodies. Rods 622, 623 and the other similar rods illustrated or discussed herein are configured to support the shoulder portions of shirts 510.

For collar management device 810, support 812 is V-shaped. Two slots 816 of clasps 814 are connected to two ends of V-shaped support 812. Slots 816 are positionable to clasp to two top rods of a hanger (similar to top rods 623, 622 as shown in FIG. 10*b*). Other supports may be provided for attaching collar management devices to hanger bodies such as a magnet(s), hook-and-loop fasteners, snaps, and other attachment devices known to those of ordinary skill in the art.

Supports 105, 505, 605, 812 and the other supports disclosed herein are substantially ridged to maintain the relative position of clips 104, 504, 604 and the other clips disclosed herein in position before and after being clipped to collar leaves of a shirt. Similarly, clips 104, 504, 604, etc. maintain their relative position to hanger bodies 102, 502, 602, etc. so that the collar leaves are held in a fixed position relative to the shoulder portions and other portions of the shirt. As such, there is little, if any, movement of clips 104, 504, 604, etc. as a whole relative to each other and hanger bodies 102, 502, 602, etc. when clips 104, 504, 604, etc. are attached to the collar leaves.

Although the present invention has been illustrated and described herein with reference to preferred embodiments and specific examples, it will be readily apparent to those of ordinary skill in the art that other embodiments and examples may perform similar functions and/or achieve like results. All such equivalent embodiments and example are within the spirit and scope of the present invention, are contemplated and are intended to be covered by this patent.

What is claimed is:

1. A hanger for a shirt, the hanger comprising:

a hanger body including at least two rods positioned to support shoulders of a shirt;

a hook coupled to the hanger body and configured to support the hanger body;

a pair of clips configured to clip collar leaves of a shirt, the pair of clips having outer edges cooperating to define an outer width of the pair of clips;

at least one rigid support positioned to support the clips on the hanger body; and at least two clasps coupled to the at least two rods, the at least two clasps supporting the at least one rigid support, the at least two clasps having outer edges cooperating to define an outer width of the at least two clasps that is greater than the outer width defined by the outer edges of the pair of clips.

2. The hanger of claim 1, wherein the support is upside-down Y-shaped.

3. The hanger of claim 1, where the support is detachable from at least one of the hanger body and the hook.

4. The hanger of claim 1, wherein the clips have a predetermined relative position that is substantially maintained when clipped to collar leaves.

* * * * *